US008608171B1

(12) United States Patent
Wang

(10) Patent No.: US 8,608,171 B1
(45) Date of Patent: Dec. 17, 2013

(54) GAME MACHINE WITH TAMPER RESISTANCE FUNCTION

(71) Applicant: Chih-Chieh Wang, Taichung (TW)

(72) Inventor: Chih-Chieh Wang, Taichung (TW)

(73) Assignee: Youal-Jifh Enterprise Co., Ltd., Taichung (TW)

( * ) Notice: Subject to any disclaimer, the term of this patent is extended or adjusted under 35 U.S.C. 154(b) by 0 days.

(21) Appl. No.: 13/629,756

(22) Filed: Sep. 28, 2012

(51) Int. Cl.
*A63B 67/00* (2006.01)
*A63B 71/00* (2006.01)
*A63F 9/00* (2006.01)

(52) U.S. Cl.
USPC ..... 273/447; 273/440; 273/441; 273/454; 221/210

(58) Field of Classification Search
USPC ..... 74/406; 221/210, 211; 273/451, 447, 273/459, 448, 454, 460, 440, 441; 194/215, 194/229, 239, 293, 350; 312/114, 223.1, 312/352
See application file for complete search history.

(56) References Cited

U.S. PATENT DOCUMENTS

| | | | | |
|---|---|---|---|---|
| 3,170,413 | A * | 2/1965 | Dorey | 105/282.3 |
| 5,524,790 | A * | 6/1996 | Cho | 221/150 HC |
| 5,711,530 | A * | 1/1998 | Lewis | 273/448 |
| 6,315,157 | B1 * | 11/2001 | Halliburton | 221/87 |
| 7,446,302 | B2 * | 11/2008 | Mason et al. | 250/222.1 |
| 7,519,451 | B2 * | 4/2009 | Hartnell et al. | 700/244 |
| 7,635,131 | B2 * | 12/2009 | Fukazawa et al. | 273/447 |
| 7,742,837 | B2 * | 6/2010 | Hair et al. | 700/236 |
| 7,841,599 | B2 * | 11/2010 | Todokoro | 273/447 |
| 8,016,292 | B1 * | 9/2011 | Yang et al. | 273/451 |
| 2002/0067002 | A1 * | 6/2002 | Yoshida et al. | 273/447 |
| 2002/0117509 | A1 * | 8/2002 | Whitten et al. | 221/9 |
| 2003/0097793 | A1 * | 5/2003 | Kowalczyk et al. | 49/333 |
| 2006/0042481 | A1 * | 3/2006 | Daniel et al. | 100/260 |
| 2006/0094489 | A1 * | 5/2006 | Fukazawa et al. | 463/7 |
| 2010/0133302 | A1 * | 6/2010 | Noda et al. | 222/590 |

* cited by examiner

*Primary Examiner* — Jeffrey Shapiro
(74) *Attorney, Agent, or Firm* — Alan Kamrath; Kamrath IP Lawfirm, P.A.

(57) ABSTRACT

A game machine includes a cabinet, a shutter, a sensor and a drive mechanism. The cabinet has a chute for guiding items therein to a hatch accessible to a user. The shutter is normally disposed in a closed position in the cabinet to cover the chute in order to prevent the item from entering the hatch. The sensor is provided for detecting whether an item is deposited on the shutter, and if yes, sending out a signal. Upon reception of the signal, the drive mechanism is activated to cause the shutter to move to an opening position uncovering the chute to allow entry of the detected item into the hatch.

4 Claims, 7 Drawing Sheets

GAME MACHINE WITH TAMPER RESISTANCE FUNCTION

BACKGROUND OF THE INVENTION

1. Field of the Invention

The present invention relates to a game machine and more particularly to a game machine with tamper resistance function.

2. Description of the Related Art

There are numerous game machines, such as craw cranes, which are designed to dispense items or prizes. Generally, craw cranes require the exercise of skill on behalf of the player to maneuver a capturing device, such as a claw which is suspended on a chain over a playing field which has been filled with prizes. Besides the player skill, it is understood that the success rate winning a prize is dependent on several other factors, including operator settings, type of machine, and prizes available (size, density, and distribution). However, it is frustrated to know that a prize may be lost due to a specific crane configuration, which is tricky and extremely unfair to the player. For example, all modern claw machines incorporate some means for the owner to adjust at least the strength of the claw's grip and how closely the claw's fingers pull together. Some machines incorporate a feature called two-level claw power, which, when enabled, causes the claw to at first grip at full strength, but then weaken its grip to the normal level after a brief delay. This can cause the crane to initially pick up the prize, but then drop it.

To increase the fairness and provide a game machine capable of preventing a player from feeling unfairness, another type of game machine is disclosed as shown in FIG. 7, which generally includes a cabinet 1, a controller 11 disposed on a front of the cabinet 1, shelves 12 for accommodation of items or prizes, and a hammer mechanism 13 electrically coupled to the controller 11. An operator can manipulate the controller 11 to control positioning of the hammer mechanism 13. And hitting motion of the hammer mechanism 13 onto the shelves 12 may be translated to vibration of the shelves 12 causing one or more items falling off the shelves 12 and dispensed through a chute 14 into a hatch 15 for collection. However, since the chute 14 is always open at its interior port for receiving items, the machine may easily be tampered by tilting the cabinet 1 to cause the items to fall out of the shelves 12 and through the chute 14 into the hatch 15, causing a big loss for the machine owner.

SUMMARY OF THE INVENTION

To solve the problems mentioned above, the present invention provides an improved game machine with an anti-tampering shutter which is designed to frustrate tampering with the machine such as by tilting the cabinet to cause items to fall out.

Specifically, the game machine includes a cabinet, the shutter disposed in the cabinet, a sensor for detecting an item and a drive mechanism for movement of the shutter. The cabinet includes a chute for guiding items therein to a hatch accessible to a user. The shutter is disposed normally in a closed position to cover the chute to prevent items from entering the hatch. The sensor is configured to detect whether an item is deposited on the shutter, and if yes, send out a signal. The drive mechanism is configured to be activated by the signal to cause the shutter to move to an opening position uncovering the chute to allow entry of the detected item into the hatch.

Since an interior port of the chute is normally covered by the shutter, the blocking of the port makes unauthorized access to the protected items harder and therefore frustrates tampering. Further benefits and advantages of the present invention will become apparent after a careful reading of the detailed description with appropriate reference to the accompanying drawings.

BRIEF DESCRIPTION OF THE DRAWINGS

A game machine according to the invention will now be described, by way of example, with reference to the accompanying drawings, in which.

DETAILED DESCRIPTION OF PREFERRED EMBODIMENT

Referring to FIGS. 1-6, a game machine is provided in accordance with the preferred embodiment of the present invention. The game machine includes a cabinet 2, an anti-tampering shutter 21 disposed in the cabinet 2, a set of sensors 241, 242 for detecting items on the shutter 21 and a drive mechanism (FIG. 3) for movement of the shutter 21.

Figure 1:
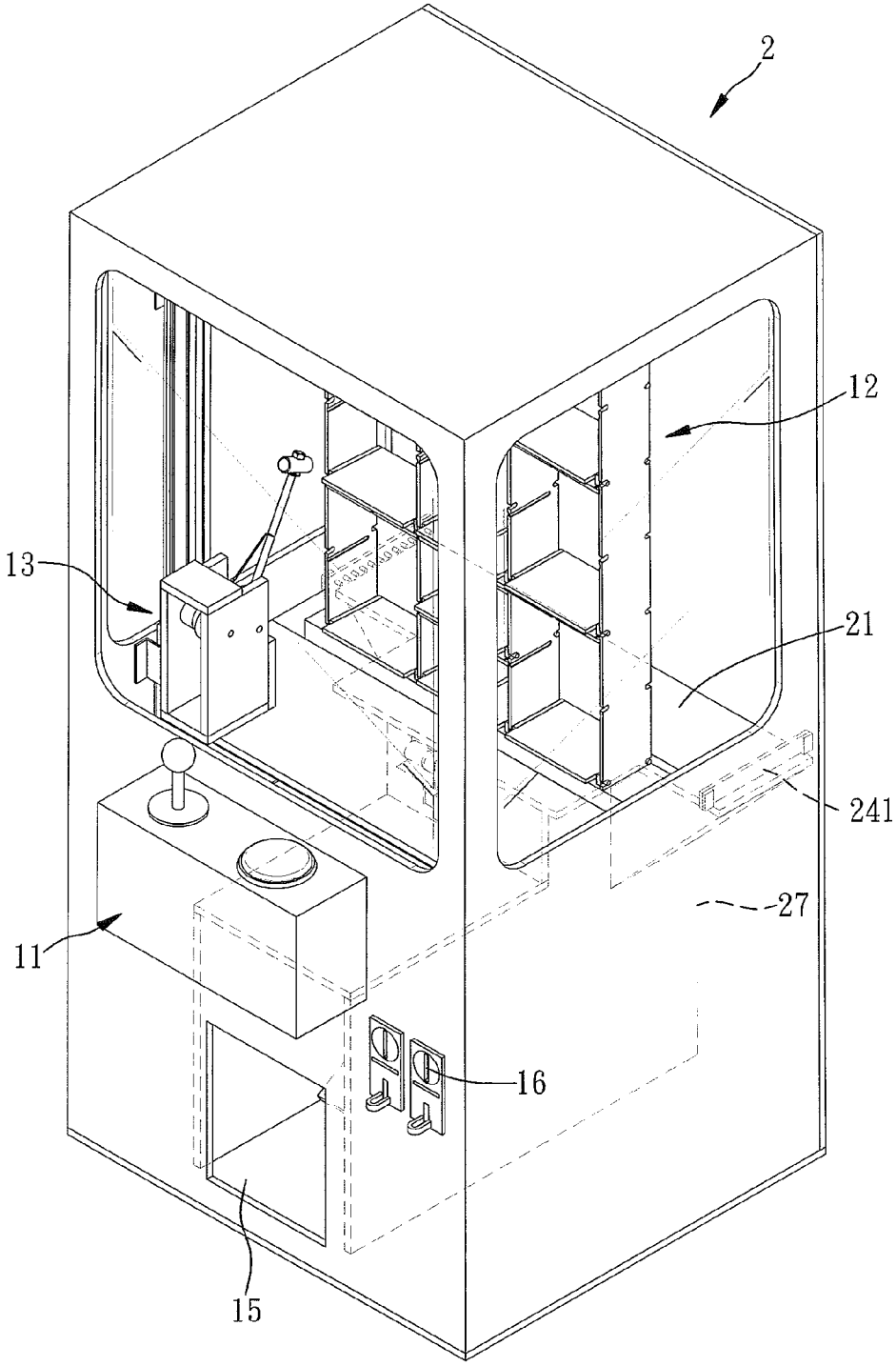
FIG. 1 is an isometric view of the game machine.
Figure 2:
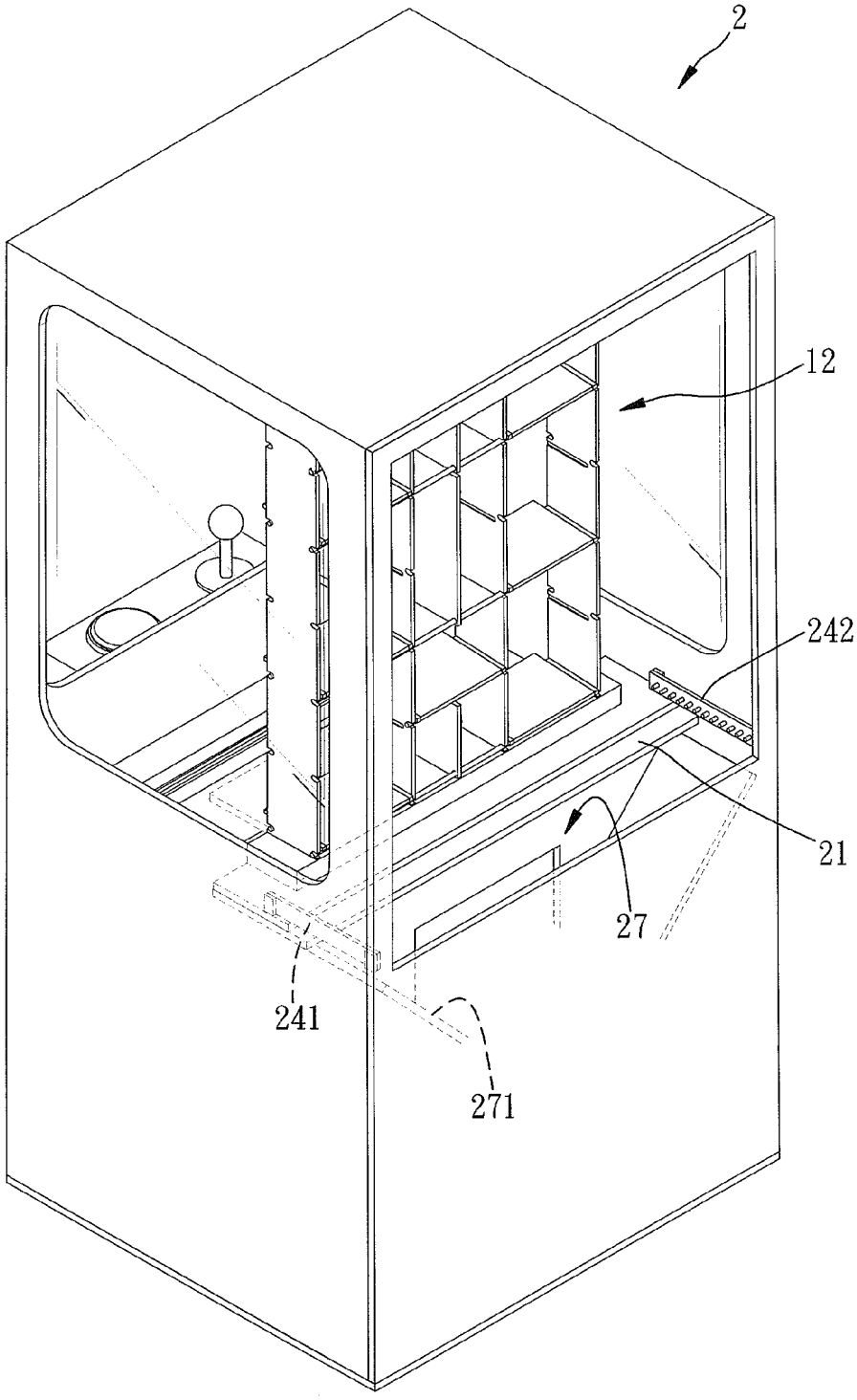
FIG. 2 is another isometric view of the game machine taken from another angle.

As best shown in FIG. 1, the cabinet 2 includes shelves 12 for accommodation of items or prizes and a chute 27 for guiding falling items to a hatch 15 accessible to a user. A controller 11 is disposed in a front of the cabinet 2 for controlling positioning of a hammer mechanism 13 to hit against shelves 12 so as to shake items out of the shelves 12. Referring to FIG. 2, if the chute 27 is not shut by the shutter 21, the falling items may further drop into the chute 27 which has an enlarged port defined by tilted guide walls 271 for access of the items into the chute 27.

Figure 4:
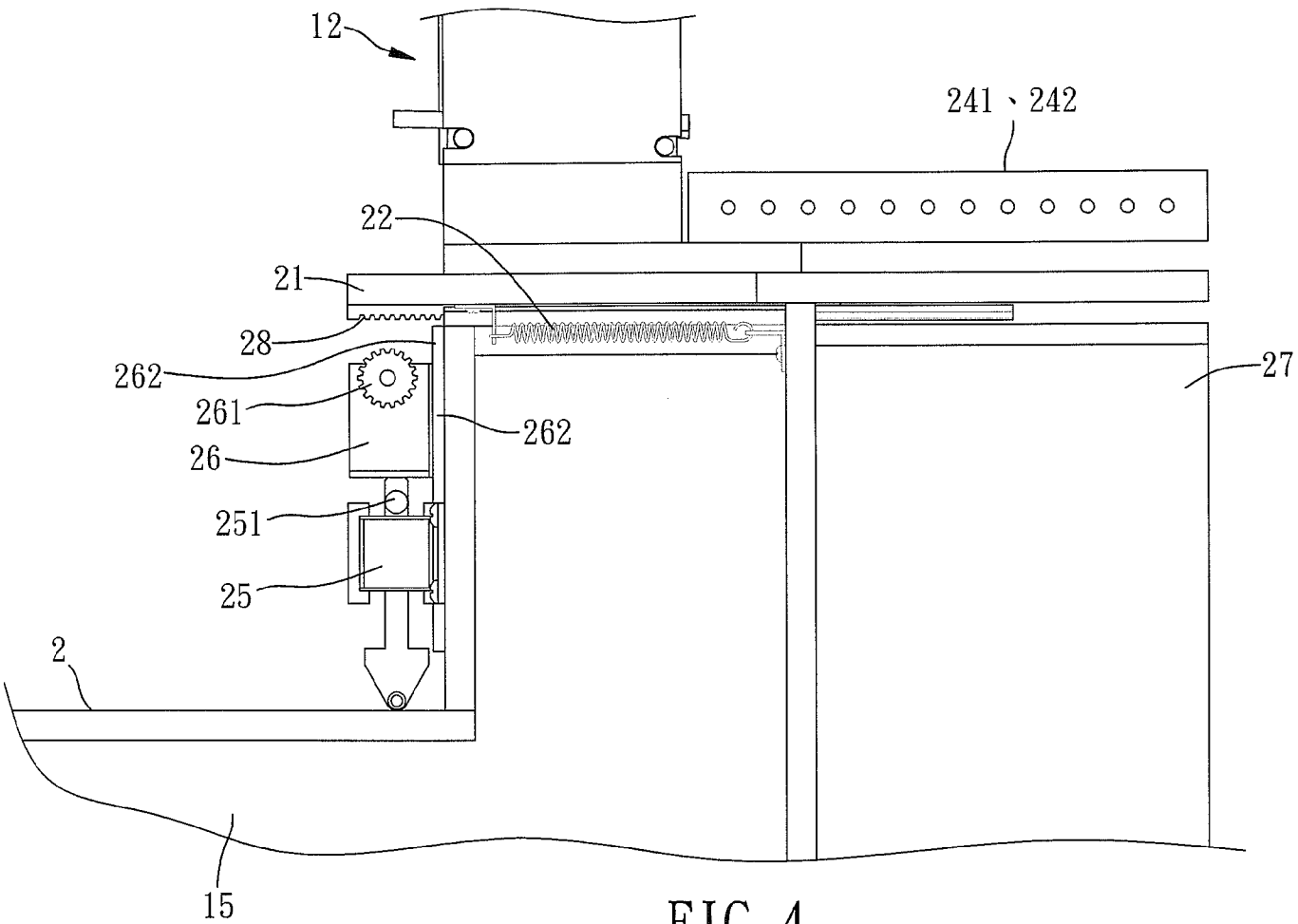
FIG. 4 is a fragmentary side view of the game machine, showing that the shutter is in a closed position.

As shown in FIG. 1 or 4, the shutter 21 is disposed normally in a closed position to cover the chute 27 to prevent items from entering the hatch 15. The set of sensors 241, 242 is provided for detecting whether an item is deposited on top of the shutter 21, and if yes, sending out a signal.

Figure 3:
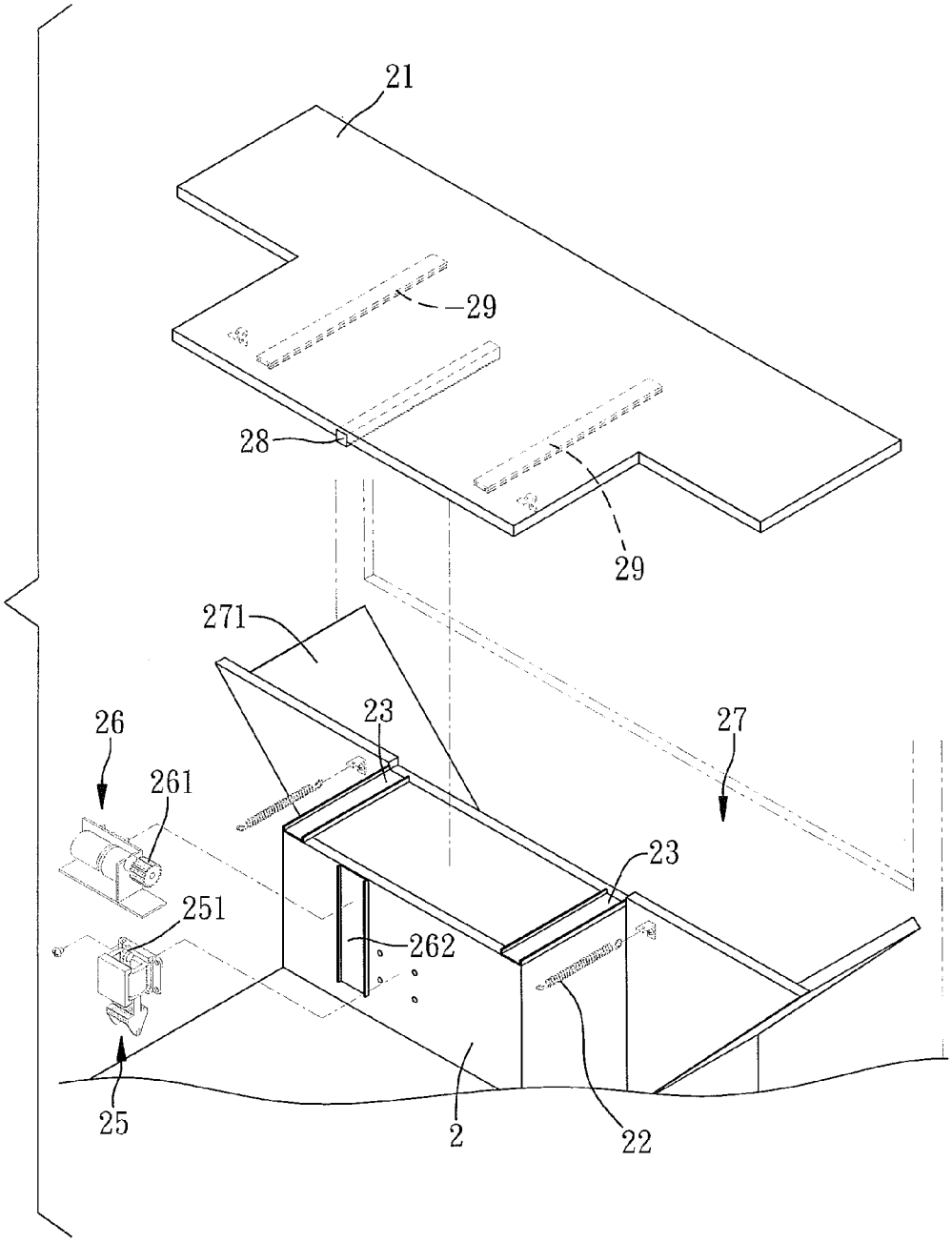
FIG. 3 is a fragmentary exploded perspective view of the game machine.

Referring to FIG. 3, the drive mechanism is configured to be activated by the signal to cause the shutter 21 to move to an opening position uncovering the chute 27 to allow entry of the detected item. Specifically, the drive mechanism includes a rack 28 mounted underneath the shutter 21, a motor 26 electrically coupled to the set of the sensors 241, 242, a gear 261 mounted around a driving shaft of the motor 26, and a lifting member 25 electrically coupled to the set of the sensors 241, 242.

Figure 5:
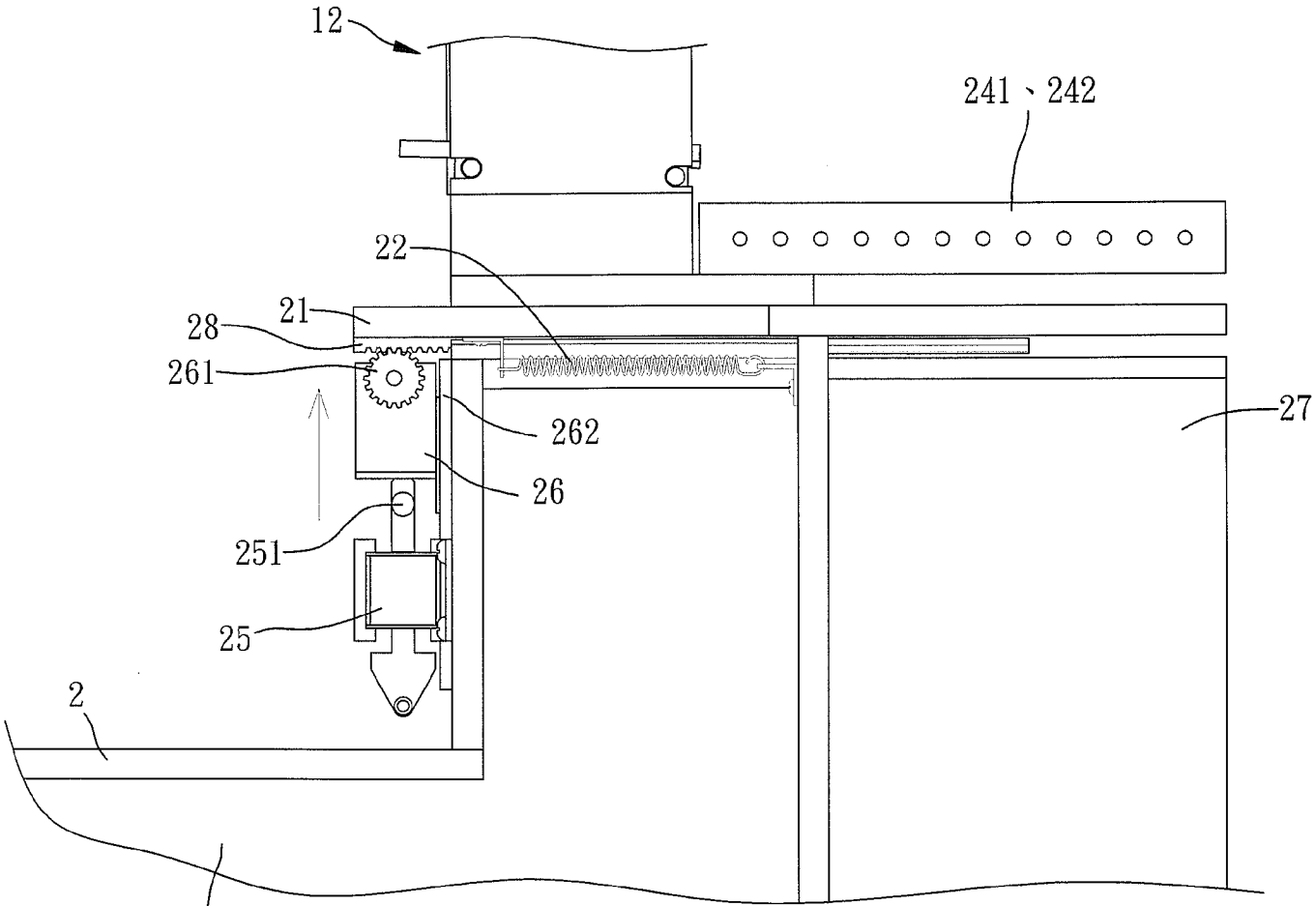
FIG. 5 is a view similar to that of FIG. 4 but with a gear driven by a motor being lifted to mesh with a rack underneath the shutter.
Figure 6:
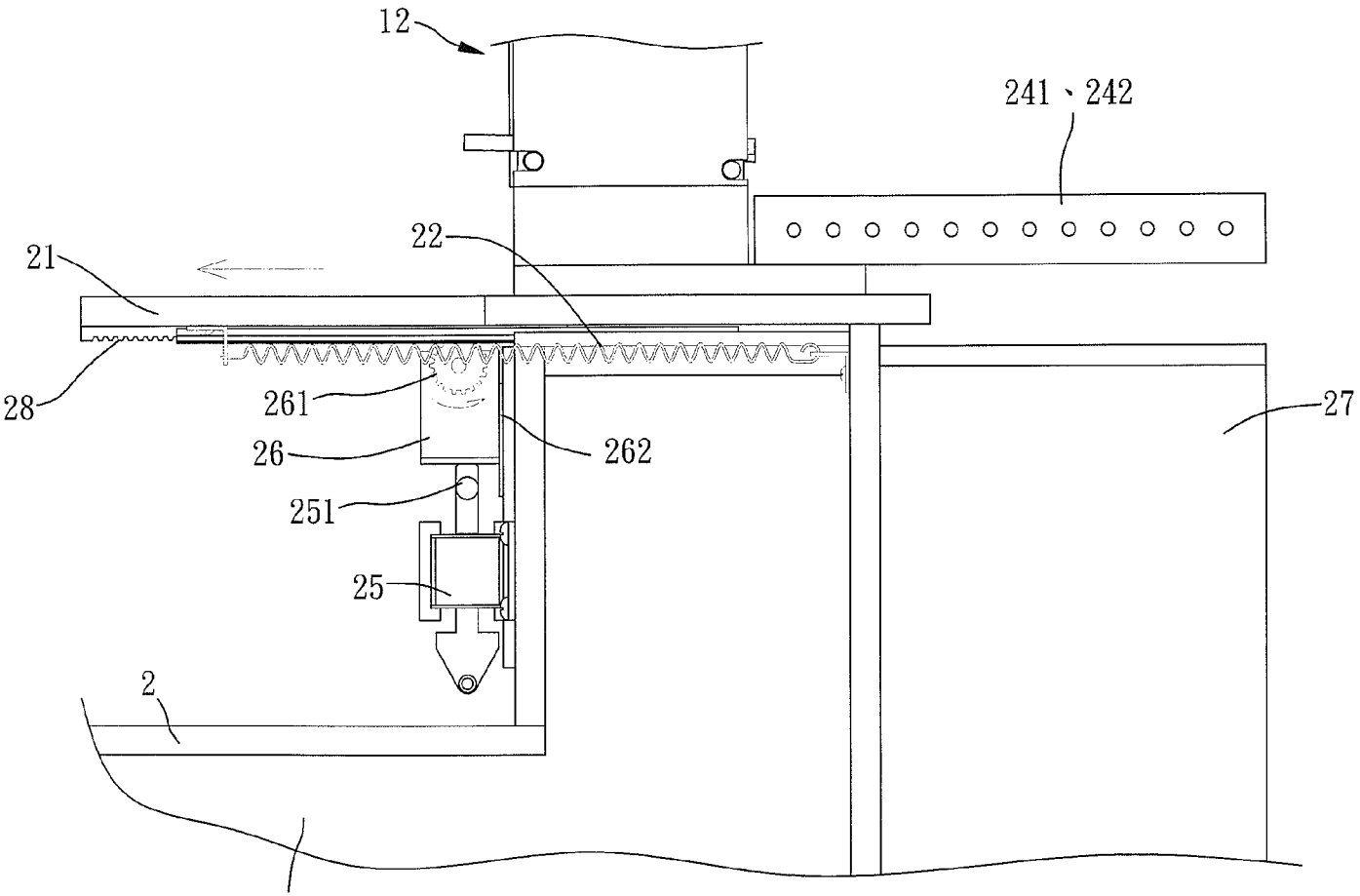
FIG. 6 is a view similar to that of FIG. 5 but with the shutter located in an opening position.
Figure 7:
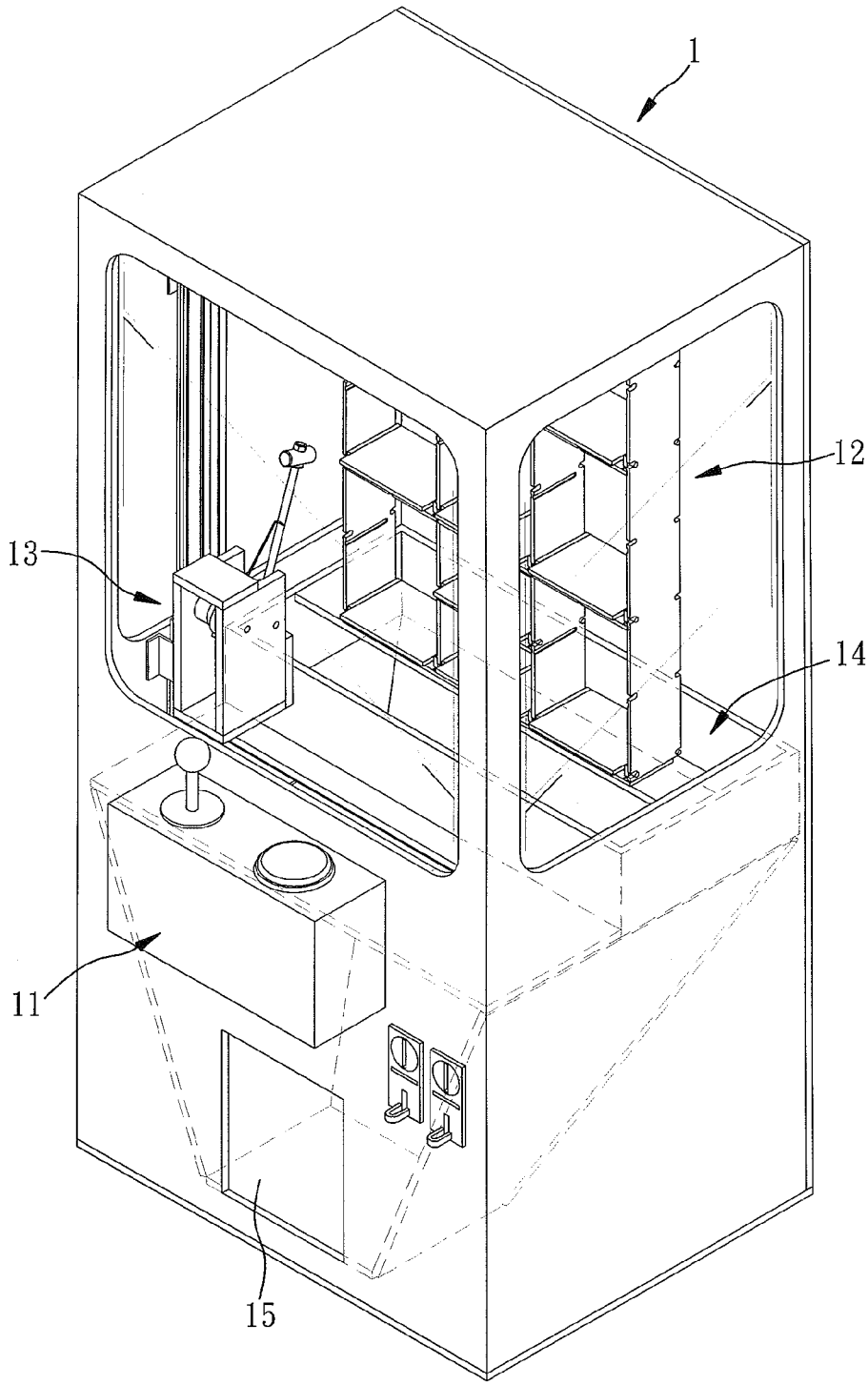
FIG. 7 (PRIOR ART)
FIG. 7 is a prior art.

Referring to FIG. 4, the lifting member 25 is configured to be activated by the signal to lift the motor 26 toward the shutter 21 to have the gear 261 mesh with the rack 28, as shown in FIG. 5, which in turn brings the shutter 21 to the opening position uncovering the chute 27, as shown in FIG. 6. In this example, the lifting member 25 is a solenoid containing a central rod 251 on which the motor 26 is seated. The solenoid 25 causes the central rod 251 to move upward to lift the motor 26 and therefore have the gear 261 mesh with the rack 28. Activation of the motor 26 by the signal drives the gear 261 to rotate which in turn displaces the rack 28 and therefore have the shutter 21 move to the opening position. Preferably, as shown in FIG. 3, a track 262 may be included in the drive mechanism to stabilize the lifted motor 26, and a pair of rails 23 may be provided to guide the movement of the shutter 26 which is equipped at bottom with a pair of sliding bars 29 corresponding to the rails 23.

Referring again to FIG. 3, the drive mechanism further a pair of elastic members 22, such as helical springs, each secured to the bottom of the shutter 21 with one end and to the cabinet 2 with the other end. Referring to FIG. 6, the helical springs 22 are stretched so that if the gear 261 is further detached from the rack 28 because of downward movement of the central rod 251, the helical springs 22 will draw the shutter 21 back to the closed position, as shown in FIG. 4. The springs 22 normally maintain the shutter 21 in the closed position to frustrate tampering.

In operation, coins may be fed into a coin slot 16 (FIG. 1) at the front of the cabinet 2 for energizing the game machine for play. When the game machine is energized, the set of sensors 241, 242 and the drive mechanism are started up. Afterward, if any items are shaken out of the shelves 12 and fall down to the shutter 21, the items on the shutter 21 will be detected by the set of sensors 241, 242 and the signal will be send out. Upon reception of the signal, the lifting member 25 is activated to lift the motor 26 to have the gear 261 mesh with the rack 28 which in turn brings the shutter 21 to the opening position. At this time, the items will fall through the chute 27 into the hatch 15. After that, since no items stay on the shutter 21, the set of sensors 241, 242 will send no signals out. Without the signal, the lifting member 25 will lose power causing the central rod 251 to retract and release the gear 261 from the rack 28, and therefore the shutter 21 will be drawn back to the closed position by the elastic members 22. This ensures that if the game machine is not used, the shutter 21 is always located in the closed position to frustrate tampering.

It is to be understood that the disclosed embodiments are illustrative in nature and the invention is not to be limited to any one or more embodiments except as set forth in the following claims.

What is claimed is:

1. A game machine comprising:

a cabinet including a chute for guiding items therein to a hatch thereof;

a shutter disposed normally in a closing position in the cabinet to cover the chute to prevent items from entering the hatch;

a sensor for detecting whether an item is deposited on the shutter, and if yes, sending out a signal; and a drive mechanism including at least one elastic member formed with an end secured to the shutter and another end secured to the cabinet, a rack placed beneath the shutter, a motor electrically coupled to the sensor, a gear operatively connected to the motor, a lifting member adapted to move the motor toward the shutter to mesh the gear with the rack to bring the shutter into an opening position after receiving the signal, wherein the lifting member is further adapted to move the motor from the shutter to disengage the gear from the rack to allow the elastic member to abruptly return the shutter into the closing position when the signal is stopped.

2. The game machine of claim 1, wherein the drive mechanism further includes a track disposed in the cabinet to stabilize the motor while the motor is lifted.

3. The game machine of claim 1, further comprising a coin slot into which coins can be inserted for energizing the game machine for play, wherein the sensor and the drive mechanism are configured to function only when the game machine is energized by insertion of coins to the coin slot.

4. The game machine of claim 1, wherein the chute includes tilted guide walls that together define a port for access of the item to the chute.

* * * * *